United States Patent [19]

Provost et al.

[11] Patent Number: 4,654,246

[45] Date of Patent: Mar. 31, 1987

[54] SELF-ENGAGING SEPARABLE FASTENER

[75] Inventors: George Provost, Manchester; Marcel C. Ouellette, Bedford, both of N.H.

[73] Assignee: Actief, N.V., Curaco, Netherlands Antilles

[21] Appl. No.: 772,591

[22] Filed: Sep. 5, 1985

[51] Int. Cl.[4] ..... B32B 3/06

[52] U.S. Cl. ..... 428/88; 26/2 R; 26/8 R; 26/8 C; 26/29 R; 139/2; 428/100

[58] Field of Search ..... 428/88, 92, 100; 139/2; 28/214; 26/2 R, 8 R, 8 C, 29 R; 156/72

[56] References Cited

U.S. PATENT DOCUMENTS 4,058,853 11/1977 Boxer et al. ..... 428/100

4,165,555 8/1979 Boxer et al. ..... 428/100

*Primary Examiner*—Marion C. McCamish

*Attorney, Agent, or Firm*—Pennie & Edmonds

[57] ABSTRACT

A self-engaging separable fastener is disclosed which comprises a base member of woven separable fastener material having at least two adjacent mating fastener sections. At least one section is defined by a plurality of loops upstanding from the base member, and the other section is defined by a plurality of hooks upstanding from the base member. The loops are formed of respective generally parallel rows of multifilament yarns interwoven into their respective base section so as to repeat the same loop direction and construction every predetermined number of picks and the hooks are cut from respective generally parallel rows of loops of monofilament yarns interwoven into their respective base section so as to repeat their loop direction and construction every predetermined number of picks, which latter number of picks is greater than the number of picks in which the direction of the multifilament loops is repeated. The density of the monofilament hooks is less than the density of the multifilament loops such that the sections of fastener material may be placed in face-to-face engagement by folding one section over the other and pressing the surfaces together and separated by peeling forces normal to the interfacial plane of engagement. Preferably the loops repeat themselves every four picks and the hooks repeat themselves every eight picks.

27 Claims, 10 Drawing Figures

SELF-ENGAGING SEPARABLE FASTENER

BACKGROUND OF THE INVENTION 1. Technical Field

This invention relates to a self-engaging composite separable fastener product of the hook and loop-type. The invention also relates to a method of producing the inventive product.

2. Description of the Prior Art

Hook and loop fastener strips are well known and are used to join two parts detachably to each other. These fastener strips consist of mating fastener tapes having hooks and loops set respectively on either tape, which on being pressed together will interlock and so form a connection. Such fastener strips are employed in numerous applications including wearing apparel, for example outer apparel, and are also found on footwear and leather goods such as bags or the like.

Such hook and loop-type fasteners are described in U.S. Pat. Nos. 2,717,437 and 3,009,235 which are marketed under the registered trademark VELCRO brand hook and loop fasteners by Velcro USA Inc., Manchester, N.H. 03108 have gained wide acceptance because of the properties of the mating hooks and loops which permit their attachment by merely placing a surface defined by the hooks into face-to-face relationship with a surface defined by the loops so that a large number of hooks engage a large number of loops which resist separation parallel to the interfacial plane of engagement but are readily separable by peeling forces applied substantially normal to this interfacial plane. The loop component of these fasteners is generally formed of a sheet of woven fabric having raised threads of multifilament synthetic material, such as nylon, which are napped or unnapped, to provide a pile surface defined by a plurality of loops, and which may be thermally treated to become semi-rigid. The hook part of these fasteners is generally formed of a separate sheet of woven fabric having raised monofilament loops which are subsequently cut to form hooks.

While these fasteners provide excellent holding properties where repeated engagements and disengagements are required, often it is desirable to provide a continuous fastener member having one section containing upstanding loops and a second section containing upstanding hooks so as to enable portions of the fastener to be folded upon themselves to provide the necessary fastening, as by placing the fastener in tension when utilized as a fastener for footwear.

In commonly assigned U.S. Pat. No. 4,426,363 to Girard, a composite length of pile fabric sheet material is disclosed whereby two sections of such mating fastener materials are joined together. Thus the hook section can be matched with the loop section (i.e. hook and loop relative densities and heights) to provide effective fastening and separation of the sections. While this invention has been successful over the years, the fastener nevertheless requires a separate step to join the separate sections, thus not only adding to the cost of manufacture, but introducing an element of potential weakness in the strap. Moreover, since the sections are often joined by ultrasonic welding or stitching techniques the fastener sections are overlapped with each other thus creating an area of increased thickness and resistance to folding. This sometimes presents a particular disadvantage such as in footwear applications where added thickness to the fastener can cause added discomfort to the wearer.

Subsequent to the development of the fastener of U.S. Pat. No. 3,426,363 to Girard attempts were made to weave a composite fastener on a single loom whereby adjacent hook and loop tape sections could be produced having a common base member. However, these fasteners had insufficient desirable holding power because the loop density of the loop section thus produced did not match the hook density of the hook section. We have invented a composite self-engaging fastener which avoids these aforementioned disadvantages.

SUMMARY OF THE INVENTION

A self-engaging separable fastener which comprises a sheet of woven separable fastener material having at least two adjacent mating fastener sections, at least one section defined by a plurality of loop-like engaging elements upstanding from the base member, the other section defined by a plurality of hook-type engaging elements upstanding from said base member, the loop-like engaging elements being formed of respective generally parallel rows of loops of multifilament yarns interwoven into their respective base section so as to repeat the same loop direction every predetermined number of picks and the hook-type engaging elements being cut from respective generally parallel rows of loops of monofilament yarns interwoven into their respective base section so as to repeat their loop direction every predetermined number of picks, which latter number is greater than the number of picks in which the direction of said multifilament loops is repeated, whereby the number of interwoven monofilament hook-type engaging elements per unit length along the warp direction is less than the number of interwoven multifilament loops per unit length along the warp direction. The sections of fastener material may thus be placed in face-to-face engagement by folding one section over the other and pressing the surfaces together and separated by peeling forces normal to the interfacial plane of engagement.

The base member and the hook-type and loop-type elements of the self-engaging separable fastener of the present invention are preferably formed from nylon yarns. Alternatively the base member and/or the upstanding elements may be formed of polyester or polypropylene yarns or various combinations therof.

The self-engaging separable fastener of the invention preferably comprises a backing substrate of at least one of vinyl, leather and canvas attached to the side of said base member opposite said fastening side.

In its preferred form the self-engaging separable fastener comprises a sheet of woven separable fastener material having at least two adjacent mating fastener sections, at least one section having a base member and a plurality of loop-like engaging elements upstanding therefrom, the other section having a base member woven continuous with the base member of the first section and having a plurality of hook-type engaging elements upstanding therefrom. The loop-like engaging elements are formed of respective generally parallel rows of loops of multifilament yarns interwoven into their respective base section along the warp direction so as to repeat the same loop direction and construction at least about every four picks. The hook-type engaging elements are cut from respective generally parallel rows of loops of monofilament yarns interwoven into their respective base section along the warp direction preferably so as to repeat their loop direction and construction at least about every eight picks, whereby the number of interwoven monofilament hook-type engaging elements per unit length along the warp direction is approximately half the number of interwoven multifilament loops per unit length along the warp direction, and the sections of fastener material may be placed in face-to-face engagement by folding one section over the other and pressing the surfaces together and separated by peeling forces normal to the interfacial plane of engagement.

The invention also relates to a method of producing a self-engaging separable fastener which comprises: feeding to a weaving loom, base yarns, monofilament hook yarns and multifilament loop yarns; weaving a base member across the width of the loom while simultaneously interweaving into a first section, a plurality of multifilament loops, and into the adjacent section, a plurality of monofilament loops, the multifilament loop direction and construction being repeated every predetermined number of picks, and the monofilament loop direction and construction being repeated every number of picks, said latter number of picks being greater than the number of picks for which the direction and construction of said multifilament loops are repeated.

The method also comprises subjecting the fastener to a scouring solution to scour the yarns. Thereafter the fastener is subjected to a napping operation.

The method also comprises subjecting the fastener to heat sufficient to heat set the multifilament and monofilament loops and the continuous base member, and thereafter applying an adhesive type coating to the rear surface of the base member. Either water based or solvent based adhesive may be applied. In addition the method further comprises cutting the monofilament loops to form hooks, and dyeing the fastener prior to applying said adhesive coating to the rear surface of the base member.

A substrate material may be attached to the rear surface of the base member of the fastener. Further, the fastener is preferably cut into strap sections along cut lines oriented at an acute angle with respect to the direction of the warp yarns.

In its preferred form the method of producing the self-enganging separable fastener of the invention comprises: feeding to a weaving loom, base yarns, a monofilament hook yarns and multifilament loop yarns; weaving a base member across the width of the loom while simultaneously interweaving into a first section, a plurality of multifilament loops and into the adjacent section, a plurality of monofilament loops, the multifilament loop direction and construction being repeated at least every four picks, and the monofilament loop direction and construction being repeated at least every eight picks, whereby the number of interwoven monofilament loops per unit length along the warp direction is approximately half the number of interwoven multifilament loops per unit length along the warp direction; and cutting the monofilament loops to form hooks.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

In the description which follows "hook-like elements" are sometimes referred to as "hooks", and "loop-like elements" are sometimes referred to as "loops". Since the hooks of the hook section are cut from monofilament loops, for convenience, the "hooks", and the "hook section" are sometimes referred to as "monofilament loops" or "monofilament loop section", respectively. The subsequent conversion of the monofilament loops to monofilament hooks is thus contemplated and described. Moreover, since the multifilament loops of the loop section are ultimately napped to form a greater number of fine filament loops than the number of multifilament loops which are first interwoven into the base member, for convenience the loops of the loop section are sometimes referred to as "multifilament loops". Thus a single "multifilament loop" will provide, after napping, a plurality of fine filament loops.

Figure 1:
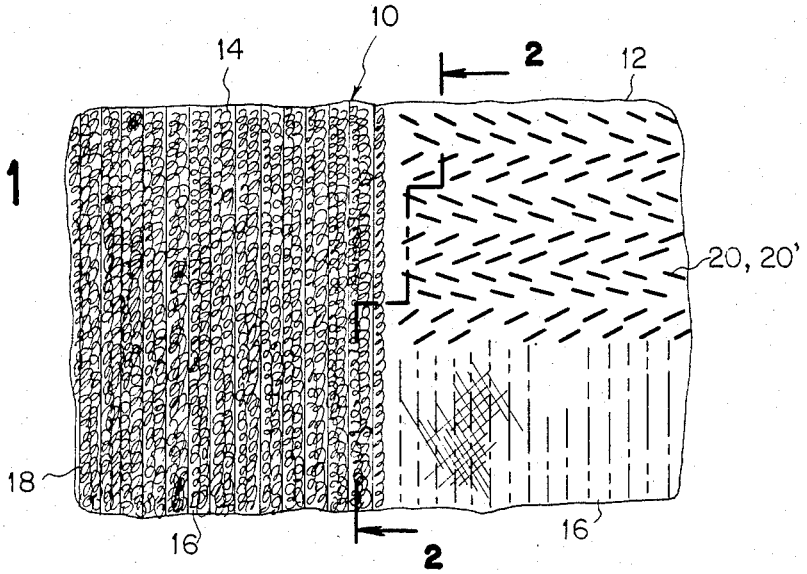
FIG. 1 is a top view of the self-engaging separable fastener constructed according to the invention.
Figure 2:
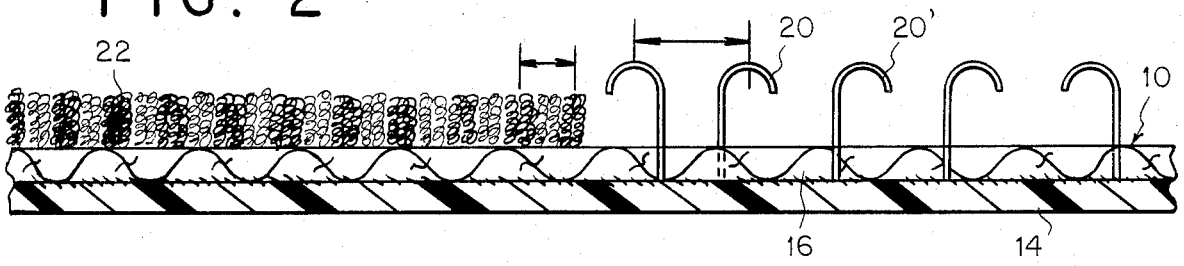
FIG. 2 is a view taken along lines 2—2 of FIG. 1 illustrating the construction of the loop section which is adjacent the hook section.

Referring now initially to FIG. 1. there is illustrated the self-engaging separable fastener 10 of the invention having a first loop section 12 defined by a base member 16 having a plurality of upstanding multifilament loop-like elements 18 and an adjacent hook section 14 defined by a continuation of the same base member 16 having a plurality of upstanding hook-like elements 20. The base member 16 is common to both sections 12 and 14 and the loop-like elements are formed by interweaving a plurality of multifilament loops into the base member 16 so as to be upstanding therefrom, while the hook-like elements are formed by simultaneously interweaving a plurality of monofilament loop elements into the base member 16 upstanding therefrom. Thus the multifilament loops and the monofilament loops are woven into the base member 16 while it is being formed and thereafter the surface is napped to separate the individual multifilaments of fine yarns which form the multifilament loops so as to provide a thick, plush surface. Also, the monofilament loop elements 20 are cut to form upstanding monofilament hooks 20' as shown in FIG. 2 so as to be suitable for engagement and disengagement with the plush surface of fine filament loops.

Referring once again to FIG. 2 there is illustrated the self-engaging separable fastener 10 of FIG. 1 taken along lines 2—2 of FIG. 1. In this Fig. there is illustrated the fastener 10 having woven base member 16 and monofilament hook elements 20' which have been cut from monofilament loops 20. For convenience of illustration only one example of the monofilament loops 20 in its condition prior to cutting is shown in FIG. 2.

The self-engaging separable fastener is preferably constructed of any combination of synthetic yarns such as nylon, polyester, polypropylene, or the like; however depending upon the end use and particular needs, any combinations of such yarns—or even alternative suitable equivalent yarns—may be included in the fastener. For example, for certain properties which may be desired, or for environmental reasons, the base member may be constructed of polyester, while the hooks and loops may be constructed of nylon, polypropylene or the like, or vice versa.

Figure 3:
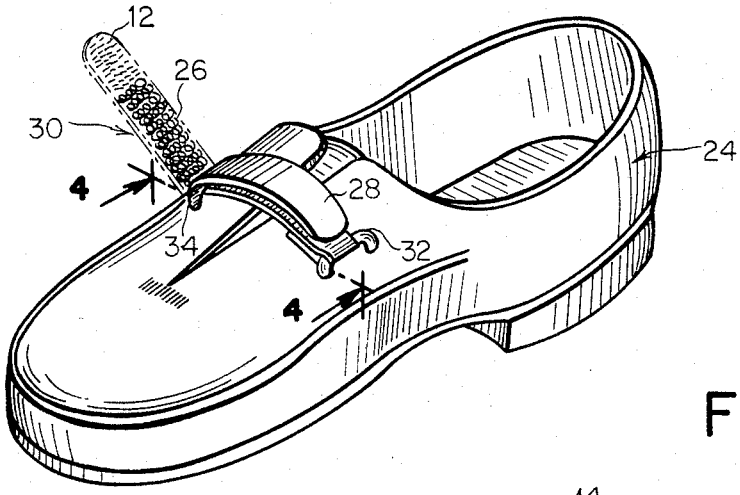
FIG. 3 is a perspective view of a preferred end use of the fastener of the invention, namely as part of the fastening strap of an article of footwear.
Figure 4:
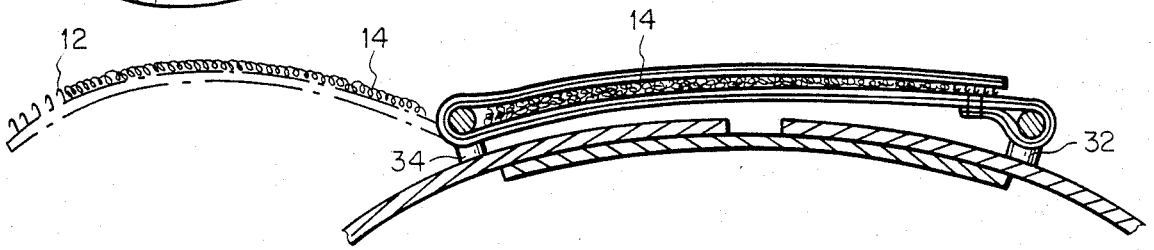
FIG. 4 is a view taken along lines 4—4 of FIG. 3.

Referring now to FIG. 3, there is illustrated a typical application of the self-engaging fastener of the invention, namely as a fastener for an article of footwear such as shoe 24. In this application a strip of the woven self-engaging fastener 10 has laminated to the rear surface of the base member 16, a suitable layer 28 of leather, vinyl or the like. The material selected will normally depend upon the material of the main product 24 (in this case, the article of footwear). The combination strap 30 is adapted to be attached to the shoe 24 by buckles 32 and 34. Thus when the strap is attached to buckle 32 and looped through buckle 34 it may be pulled tightly so as to fasten the shoe and thereafter the hook section may be pressed against loop section 14 to maintain the shoe in tightly fastened condition as illustrated in FIG. 4. The potential applications of the present invention are legion and will be readily apparent to one skilled in the art. For example, such industries as the garment industry, the luggage industry, the automobile industry, etc., will find this fastener to be readily applicable to their needs due to its composite structure which uniquely provides readily available fastening capability of both sections without the need for stitching, ultrasonic attachment glueing, etc.

Figure 5:
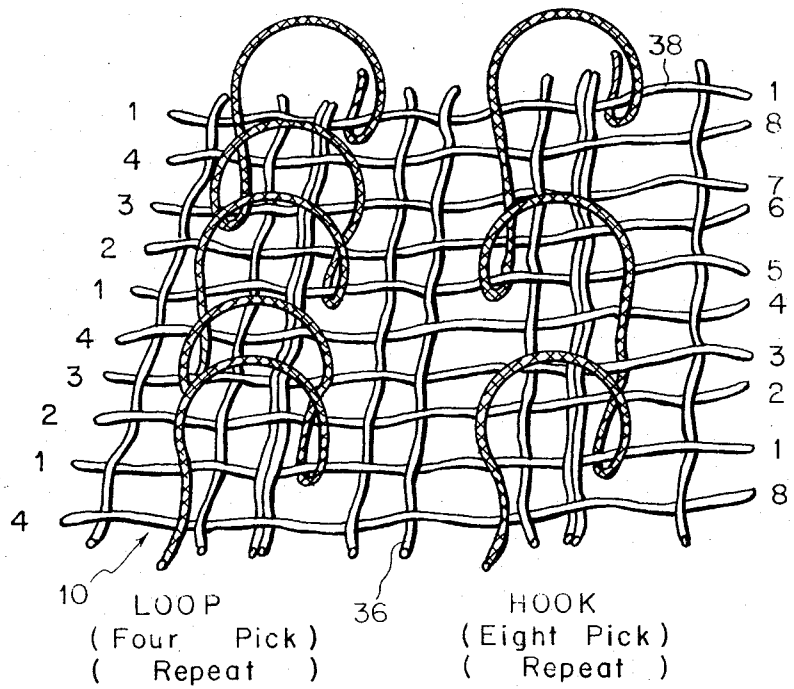
FIG. 5 is an exploded perspective view of the fastener of the invention illustrating the loop construction and the hook construction.

Referring now to FIG. 5 there is illustrated a preferred construction of the separable fastener member 10. In the construction illustrated in these Figs. the warp yarns 36 are shown extending approximately vertically as the fabric emerges from the loom and the weft yarns 38 are shown generally horizontally as they emerge from the loom. We have found that when the same construction is used for both the hook section and the loop section the density of hooks is too great to permit proper penetration of the hooks into, and in engagement with, the loops. However, by uniquely simultaneously constructing the loop section to have greater density than the hook section—over a common base member—we have discovered that the proper penetration of the hooks into the loops will take place and will provide proper securing of the two sections of the fastener. This is particularly accomplished by the construction as shown in the Figs. and as will be described hereinbelow.

Figure 6:
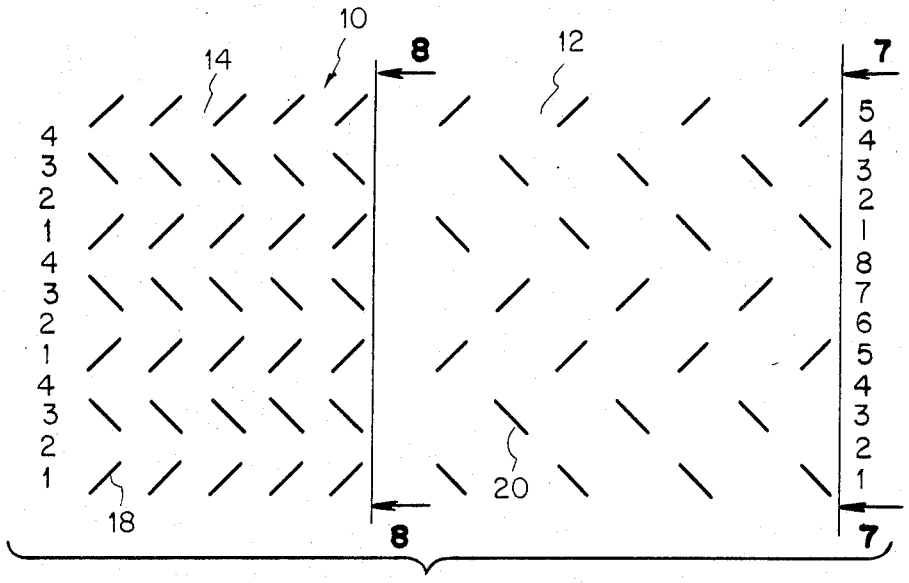
FIG. 6 is a top schematic view illustrating the relative distinctions between the weave construction of the loop section and the weave construction of the adjacent hook section.
Figure 7:
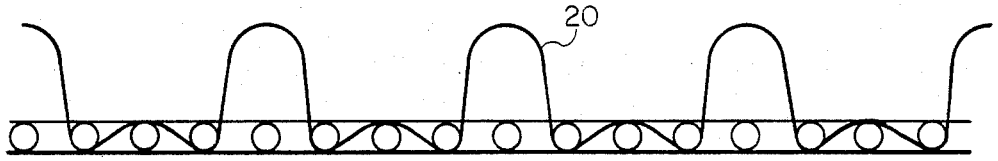
FIG. 7 is a view taken along lines 7—7 of FIG. 6, illustrating the specific weave construction of the hook section.
Figure 8:
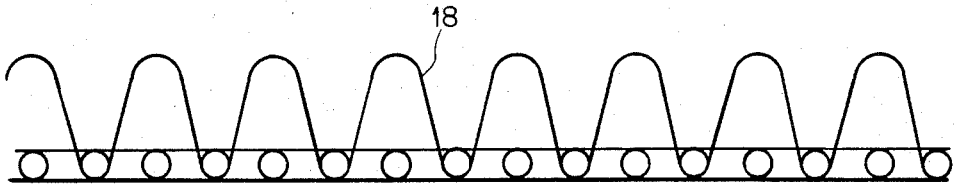
FIG. 8 is a view taken along lines 8—8 of FIG. 6, illustrating the specific weave construction of the loop section.

Referring now to FIG. 6 in conjunction with FIGS. 7 and 8 the loop section 14 and the hook section 12 of fastener 10 are illustrated. The fastener is woven on a suitable weaving loom which is adapted to interweave multifilament loops 18 and monofilament loops 20 (eventually to be cut to form hooks 20'). The multifilament loops are preferably constructed so as to repeat their direction and construction every four picks (i.e. every four wefts) and the monofilament loops 20 are preferably constructed to repeat their direction and construction every eight picks (i.e., every eight wefts). Thus the result of such weaving construction is that the hook section is less dense than the loop section; or expressed otherwise, the multifilament loops per unit length along the warp direction is approximately one-half the number of interwoven monofilament loops per unit length along the warp. Broadly stated, however, our invention contemplates a construction where the monofilament loops repeat their direction and construction every predetermined number of picks, whereby the number of picks for such occurrence for the monofilament loops is greater than the number of picks for which the multifilament loops repeat their direction and construction. Within such definition, any combination of respective repeat patterns may be developed, provided that the density of the multifilament loops is greater than the density of the monofilament hooks, and the proper relative lengths of the loops and the hooks is selected.

Referring now to FIG. 6 there is illustrated the weave pattern of both hook section 12 as viewed along lines 7—7 of FIG. 6. In FIG. 8 there is illustrated the weave pattern of the multifilament loop section 14 as viewed along lines 8—8 of FIG. 6. In the preferred construction shown—i.e., multifilament loops repeat their direction and construction every four picks and monofilament hooks repeat their direction and construction every eight picks—the monofilament hooks tend to become interwoven by a "W" weave, whereas the multifilament loops are more tightly woven into the base member. In order to more properly secure all of the members—multifilament loops as well as monofilament hooks—in accordance with the method of the invention an adhesive coating is applied to the rear surface of the base member after the fabric is heat set to stabilize the construction as will be described hereinbelow. Such adhesive may be a suitable water based or solvent based adhesive, depending upon the intended end use.

Figure 10:
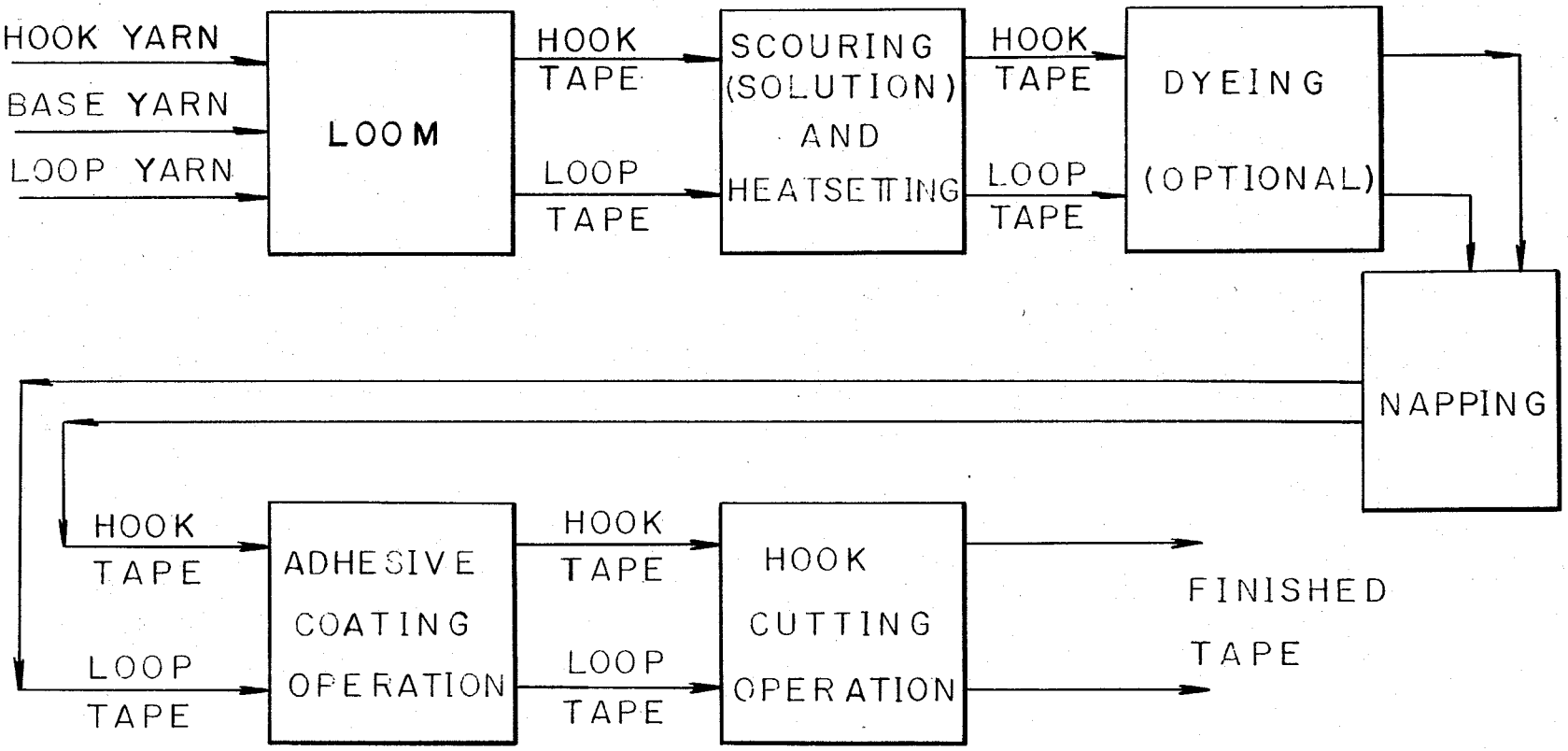
FIG. 10 is a schematic block diagram illustrating the preferred production sequence for producing the fastener according to the method of the invention.

Referring to FIG. 10 the method of producing a self-engaging fastener according to the invention is illustrated in schematic block diagram form. Loom 36 has introduced thereto, base yarns 16', monofilament yarns 18' (for hooks) and multifilament yarns 20' (for loops). The fastener fabric is formed on the loom with base 16 woven from yarns 16', which base is common to hook section 18 and loop section 20. The loom is suitably equipped for such simultaneous weaving operation by incorporating the appropriate harnesses and camming devices.

After weaving, the fabric is subjected to a scouring process during which the weaving oils and other contaminants are removed. Thereafter the fabric is subjected to appropriate heating at a temperature sufficient to heat set both the upstanding multifilaments and monofilaments and the base member to stabilize the upstanding loops and the base member and thereby improve the tightly woven grip which the woven base member retains on the loops. After heatsetting, dyeing of the fastener fabric is optional. The fabric is then subjected to a napping procedure in which the upstanding loops are subjected to the action of a rotating wire brush which separates the various filaments of the multifilament loops to provide a plush, thick surface of fine filament loops. It has been found, however, that notwithstanding the fact that the monofilament loops (i.e., to be cut to form hooks) and the multifilament loops are on the same surface, the napping brush does not adversely affect the monofilament loops. Accordingly, for convenience both surfaces may be subjected to the same napping operation to which fastener fabrics having multifilament loops alone are subjected.

After napping, the rear surface of the base member 16 is coated with an adhesive material to further stabilize the base member as well as to increase relatively tight hold which the base weave has on the upstanding members. Thereafter, the fabric is subjected to a hook cutting operation in which the monofilament loops 20 are cut as shown in FIG. 2 to form monofilament hooks 20'. As noted previously, the finished fastener tape may be attached directly to an end use product or it may be provided with an additional backing material such as a leather, vinyl, canvas, etc. backing member which would be laminated or otherwise attached to the rear surface of the base member for use in securing end use articles such as footwear as shown in the manner illustrated in FIG. 3. As noted, other potential applications are legion.

Figure 9:
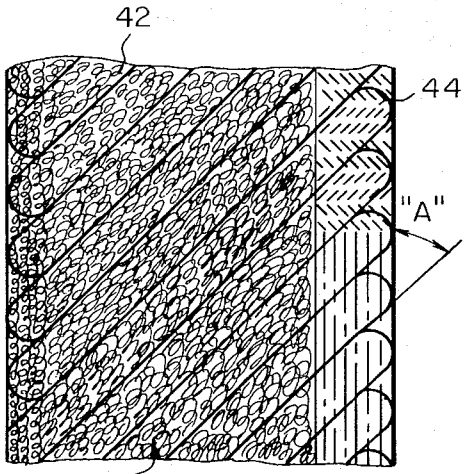
FIG. 9 is a top view of the fastener of the invention illustrating a preferred cutting arrangement for dividing the basic fastener into separable fastener strips for specific applications, as in footwear.

Referring now to FIG. 9 there is illustrated a preferred technique for cutting our fastener fabric into fastener straps of lesser width and of efficient construction which maximizes the use of the hooks and the loops. For example, in footwear applications as shown in FIG. 3, it is only necessary to include a hook section of shorter length than the loop section. Thus as shown in FIG. 9, the width of the loop section as seen on the loom is greater than the width of the hook section. Thereafter by cutting the fastener member—as shown—into relatively narrow strips oriented at an acute angle "A" with respect to the side edges, the resulting fastener straps 40 will have a loop section 42 greater in length than the hook section 44. This arrangement is often desirable, as it facilitates sufficient securement and adjustability by permitting the user to readily tension, and press and peel the hook section at predetermined locations along the loop surface, depending upon the degree of fastening tension desired in a given application.

We claim:

1. A self-engaging separable fastener which comprises a base member of woven separable fastener material having at least two adjacent mating fastener sections, at least one section defined by a plurality of loop-like engaging elements upstanding from said base member, the other section defined by a plurality of hook-type engaging elements upstanding from said base member, said loop-like engaging elements being formed of respective generally parallel rows of loops of multifilament yarns interwoven into their respective base section so as to repeat the same loop direction every predetermined number of picks and said hook-type engaging elements being cut from respective generally parallel rows of loops of monofilament yarns interwoven into their respective base section so as to repeat their loop direction every predetermined number of picks, which latter number of picks is greater than the number of picks in which the direction of said multifilament loops is repeated, whereby the number of interwoven monofilament hook-type engaging elements per unit length along the warp direction is less than the number of interwoven multifilament loops per unit length along the warp direction, and said sections of fastener material may be placed in face-to-face engagement by folding one section over the other and pressing the surfaces together and separated by peeling forces normal to the interfacial plane of engagement.

2. The self-engaging separable fastener according to claim 1 wherein said base member of said multifilament loop fastener section is formed from nylon yarns.

3. The self-engaging separable fastener according to claim 1 wherein said base member of said monofilament hook-type engaging element section is formed from nylon yarns.

4. The self-engaging separable fastener according to claim 1 wherein said base member of said multifilament loop fastener section is formed from polyester yarns.

5. The self-engaging separable fastener according to claim 1 wherein said base member of said monofilament hook-type engaging element section is formed from polyester yarns.

6. The self-engaging separable fastener according to claim 1 wherein said base member of said multifilament loop engaging element section is formed from polypropylene yarns.

7. The self-engaging separable fastener according to claim 1 when said base member of said monofilament hook-type engaging element section is formed from polypropylene yarns.

8. The self-engaging separable fastener according to claim 1 wherein the warp yarns of said base member form an acute angle with an edge of the fastener.

9. The self-engaging separable fastener according to claim 1 wherein said monofilament hook members are formed of nylon.

10. The self-engaging separable fastener according to claim 1 wherein said monofilament hook members are formed of polyester.

11. The self-engaging separable fastener according to claim 1 wherein said monofilament hook members are formed of polypropylene.

12. The self-engaging separable fastener according to claim 1 wherein said multifilament loop members are formed of nylon.

13. The self-engaging separable fastener according to claim 1 wherein said multifilament loop member are formed of polyester.

14. The self-engaging separable fastener according to claim 1 wherein said multifilament loop members are formed of polypropylene.

15. The self-engaging separable fastener according to claim 1 further comprising a backing substrate of at least one of vinyl, leather and canvas attached to the side of said base member opposite said fastening side.

16. A self-engaging separable fastener which comprises a sheet of woven separable fastener material having at least two adjacent mating fastener sections, at least one section having a base member and a plurality of loop-like engaging elements upstanding therefrom, the other section having a base member woven continuous with said base member of said first section and having a plurality of hook-type engaging elements upstanding therefrom, the loop-like engaging elements being formed of respective generally parallel rows of loops of multifilament yarns interwoven into their respective base section along the warp direction so as to repeat the same loop direction and construction at least about every four picks and the hook-type engaging elements being cut from respective generally parallel rows of loops of monofilament yarns interwoven into their respective base section along the warp direction so as to repeat their loop direction and construction at least about every eight picks, whereby the number of interwoven monofilament hook-type engaging elements per unit length along the warp direction is approximately half the number of interwoven multifilament loops per unit length along the warp direction, and said sections of fastener material may be placed in face-to-face engagement by folding one section over the other and pressing the surfaces together and separated by peeling forces normal to the interfacial plane of engagement.

17. A method of producing a self-engaging separable fastener which comprises:

(a) feeding to a weaving loom, base yarns, a monofilament hook yarns and multifilament loop yarns;

(b) weaving a base member across the width of the loom while simultaneously interweaving into a first section, a plurality of multifilament loops and into the adjacent section, a plurality of monofilament loops, the multifilament loop direction and construction being repeated every predetermined number of picks, and the monofilament loop direction and construction being repeated every number of picks, said latter number being greater than the number of picks for which the direction and construction of said multifilament loops are repeated.

18. The method according to claim 17 further comprising subjecting said fastener to a scouring solution to scour the yarns.

19. The method according to claim 18 further comprising napping at least said multifilament loop section using a napping brush.

20. The method according to claim 19 further comprising subjecting said fastener to heat sufficient to heat set said multifilament and monofilament loops and said common base member.

21. The method according to claim 20 further comprising applying an adhesive type coating to the rear surface of said base member.

22. The method according to claim 21 wherein said adhesive is one of a water based and solvent based adhesive.

23. The method according to claim 22 further comprising cutting said monofilament loops to form hooks.

24. The method according to claim 23 further comprising dyeing said fastener prior to applying said adhesive coating to the rear surface of said base member.

25. The method according to claim 24 further comprising attaching a substrate material to the rear surface of the base member of said fastener.

26. The method according to claim 25 further comprising cutting said base member into strap sections along cut lines oriented at an acute angle with respect to the direction of the warp yarns.

27. A method of producing a self-engaging separable fastener which comprises:

(a) feeding to a weaving loom, base yarns, a monofilament hook yarns and multifilament loop yarns;

(b) weaving a base member across the width of the loom while simultaneously interweaving into a first section, a plurality of multifilament loop and into the adjacent section, a plurality of monofilament loops, the multifilament loop direction and construction being repeated at least every four picks, and the monofilament loop direction and construction being repeated at least every eight picks, whereby the number of interwoven monofilament loops per unit length along the warp direction is approximately half the number of interwoven multifilament loops per unit length along the warp direction; and (c) cutting said monofilament loops to form hooks.

* * * * *